US005369413A

United States Patent [19]

Hannan

[11] Patent Number: 5,369,413

[45] Date of Patent: Nov. 29, 1994

[54] Q EQUALIZATION IN DUAL-ELEMENT END-FIRE ARRAY ANTENNAS

[75] Inventor: Peter W. Hannan, Smithtown, N.Y.

[73] Assignee: Hazeltine Corp., Greenlawn, N.Y.

[21] Appl. No.: 86,807

[22] Filed: Jul. 2, 1993

[51] Int. Cl.[5] ..... H01Q 13/10; H01Q 21/00

[52] U.S. Cl. ..... 343/770; 343/705; 343/853; 343/864

[58] Field of Search ..... 343/770, 705, 767, 768, 343/826, 708, 853, 844, 893, 831, 824, 850, 852, 860, 862, 864; 333/32, 33, 35; H01Q 13/10, 21/00

[56] References Cited

U.S. PATENT DOCUMENTS

| | | | |
|---|---|---|---|
| 3,255,450 | 6/1966 | Butler | 343/853 |
| 4,955,167 | 9/1990 | Schroeder | 343/853 |
| 4,983,988 | 1/1991 | Franke | 343/853 |
| 5,206,656 | 4/1993 | Hannan | 343/705 |
| 5,214,436 | 5/1993 | Hannan | 343/705 |

*Primary Examiner*—Donald Hajec
*Assistant Examiner*—Hoanganh Le
*Attorney, Agent, or Firm*—E. A. Onders; K. P. Robinson

[57] ABSTRACT

Mutual coupling effects, which would tend to degrade operation of a two-element end-fire array over a frequency band, are overcome by provision of an inter-element coupling impedance which is effective to equalize the Q at the inputs to the quadrature-excited elements. A quarter-wave transmission line section is coupled between the inputs to provide such impedance, which has a value selected to offset the effect of mutual coupling on Q. For a pair of monopoles, the inter-element coupling line is connected to the respective monopoles by quarter-wave sections having impedances selected in order to provide desired input impedances. The performance of dual-element end-fire slot or dipole array antennas may similarly be improved. Linear array antennas of four or more elements are provided by forced feeding of the additional elements from the basic dual-element configuration in accordance with the invention.

27 Claims, 4 Drawing Sheets

Q EQUALIZATION IN DUAL-ELEMENT END-FIRE ARRAY ANTENNAS

This invention relates to small, low-profile antennas usable on the nose of high-speed fighter aircraft and to Q equalization of rear and forward elements in dual-element end-fire array antennas usable in such applications.

BACKGROUND OF THE INVENTION

The problem of providing antennas usable on the nose of high-speed fighter aircraft requires meeting antenna performance criteria, while also meeting constraints limiting size, height, pilot view obstruction, air resistance, available mounting space, overall complexity, etc. While in many cases prior art antenna designs are available to meet desired antenna performance criteria, typically such prior designs cannot meet the very real physical constraints imposed for applications on fighter aircraft. The present inventor's prior applications directed to "Array Antenna With Forced Excitation" (No. 07/458,220, now U.S. Pat. No. 5,206,656) and to "Aircraft Antenna With Coning and Banking Correction" (No. 07/841,901, now U.S. Pat. No. 5,214,436) respectively relate to linear array antennas in which efficient broadband operation is achieved through forced excitation of three or more small radiating elements, and to antennas using a parallel array of such forced-fed antennas or other antennas.

In attempting to design two-element end-fire arrays for applications subject to such constraints, it was found that antennas using relatively large radiating elements could be provided. However, no solution permitting use of small elements while maintaining desired antenna performance over a significant operating band of frequencies was available. With small elements used in an end-fire array of monopoles, for example, the rear element has unusually low radiation resistance because of effects of mutual coupling which are severe with the small elements. This low radiation resistance increases the Q of the rear monopole, resulting in a poor impedance match over an operating frequency band.

In order to lower the Q of the rear element in such a two-element end-fire array, the height of the monopole could be increased or loss, i.e., series resistance, could be inserted. Both of these approaches are undesirable, particularly in the applications in point. For a three-element end-fire array, a solution was provided in the referenced prior applications by effectively offsetting the low radiation resistance of the rear element with the high radiation resistance of the forward element by use of a forced excitation system. That solution was effective in the three element array because the rear and forward elements are excited with signals of opposite phase. However, in a two-element end-fire array the elements are excited in quadrature phase, which precludes use of the forced excitation system.

It is therefore an object of this invention to provide improved dual-element end-fire array antennas suitable for aircraft applications, particularly those subject to size, height and other constraints.

Further objects are to provide new and improved end-fire linear array antennas utilizing small radiating elements and employing a special Q equalization circuit connected between the radiating elements, and antenna systems incorporating such linear array antennas.

SUMMARY OF THE INVENTION

In accordance with the invention, a dual-element end-fire array antenna with improved Q equalization includes a linear array of radiating elements including a rear element and forward element spaced by one-quarter wavelength at a frequency in an operating frequency band, rear coupling means, having a first impedance, for coupling signals to the rear element from a rear junction point, and forward coupling means, having a second impedance, for coupling signals to the forward element from a forward junction point. Also included are input means for coupling an input signal, feed means for coupling a first signal portion, having a reference phase, from the input means to the rear junction point and for coupling a second signal portion, having a nominally quadrature phase relation to the reference phase, from the input means to the forward junction point. The antenna further includes Q equalization means, coupled between the rear and forward junction points and having an effective length nominally equal to an odd multiple of one-quarter wavelength at a frequency in the operating frequency band, for providing an inter-element coupling impedance effective, in conjunction with the first and second impedances, to increase the conductance component of the admittance at the rear junction point.

Also in accordance with the invention, a method for improving Q equalization in a dual-element monopole or dipole end-fire array antenna, comprises the steps of:

(a) providing a pair of monopole or dipole radiating elements, including a rear element and a forward element;

(b) tuning such elements, while exciting the elements with quadrature phase signals of adjustable relative amplitudes at a selected frequency, to achieve low element reactance and a high front-to-back radiation level ratio;

(c) determining the active resistance of each of the rear and forward elements when tuned and excited as in step (b);

(d) determining the average value of the active resistances as determined in step (c);

(e) specifying the desired rear element input resistance and forward element input resistance;

(f) inserting in series with the rear element a coupling device (such as a quarter-wave transmission line section) having an impedance corresponding to the square root of the product of the average value from step (d) times the rear element input resistance from step (e);

(g) inserting in series with the forward element a coupling device (such as a quarter-wave transmission line section) having an impedance corresponding to the square root of the product of the average value from step (d) times the forward element input resistance from step (e);

(h) inserting between the coupling devices, at junction points away from the radiating elements, a transmission line section of length equivalent to an odd multiple of a quarter wavelength at a desired frequency and having an impedance corresponding to twice the product of the impedances described in steps (f) and (g), divided by the difference between the respective active resistances of the radiating elements as determined in step (c).

For a better understanding of the invention, together with other and further objects, reference is made to the following description taken in connection with the accompanying drawings and the scope will be pointed out in the appended claims.

DESCRIPTION OF THE INVENTION

Figure 1:
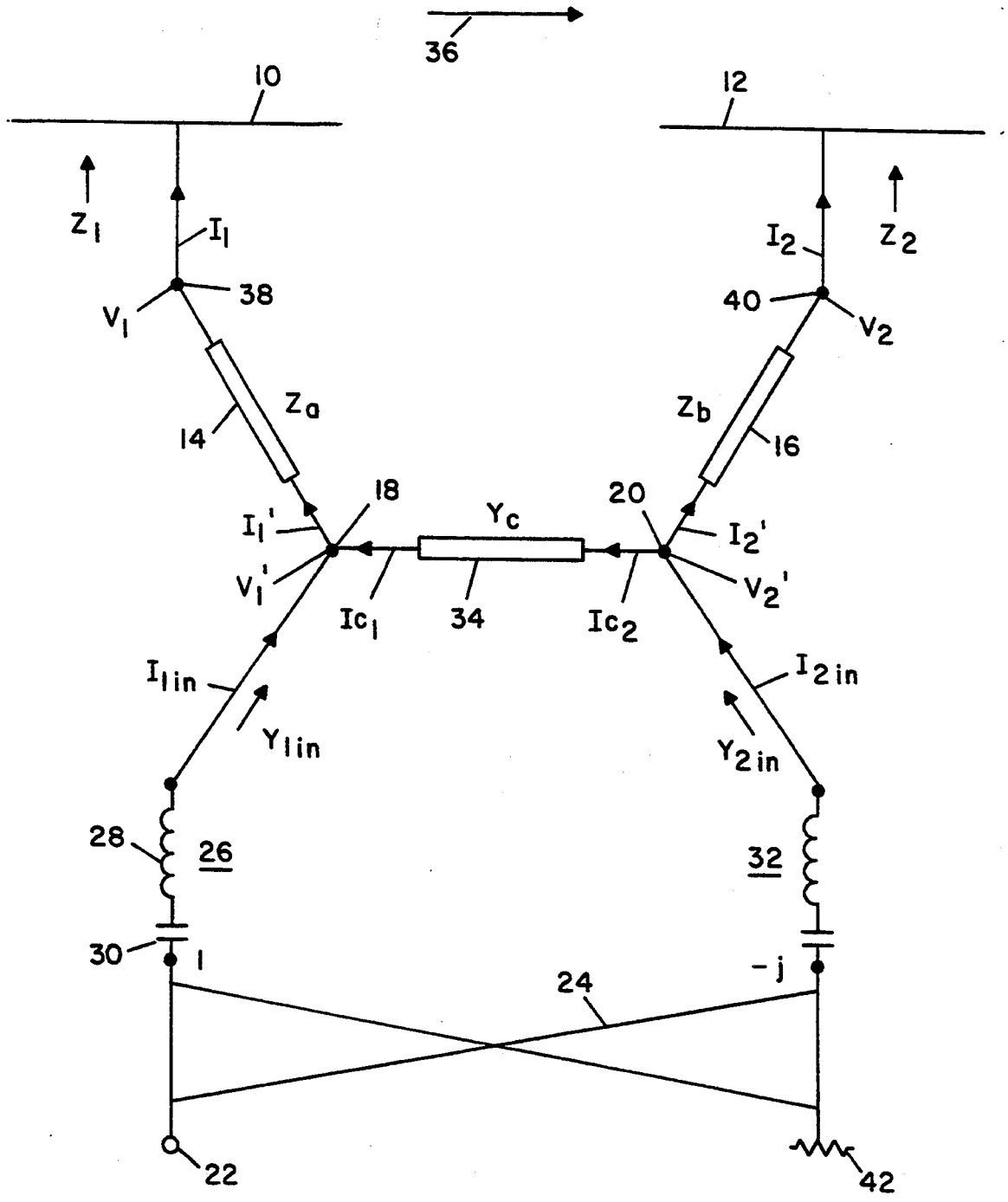
FIG. 1 shows schematically a dual-element end-fire array antenna utilizing monopoles, with an inter-element coupling impedance for Q equalization in accordance with the invention.

FIG. 1 is a schematic representation of a dual-element end-fire array antenna with Q equalization in accordance with the invention. As illustrated, the linear array of radiating elements includes a rear element, shown as top-loaded monopole 10, and a forward element, shown as a similar monopole 12. Rear coupling means, shown as comprising quarter wavelength transmission line section 14 having a first impedance $Z_a$, is arranged for coupling signals to the rear element 10 from a rear junction point 18. Similarly, forward coupling means, shown as comprising quarter wavelength transmission line section 16 having a second impedance $Z_b$, is arranged for coupling signals to the forward element 12 from a forward junction point 20. Input means, shown as terminal 22, is provided for coupling input signals to the antenna for transmission and, reciprocally, for coupling received signals from the antenna to signal utilization circuits. Feed means, for coupling a first signal portion of a reference phase from terminal 22 to rear junction point 18 and a second signal portion of lagging quadrature phase from terminal 22 to forward junction point 20, are shown as including a 3 dB type directional coupler 24, a series resonant double-tuning circuit 26 (including inductance 28 and capacitance 30, in series) connecting to rear junction point 18, and a similar double-tuning circuit 32 connecting to forward junction point 20. While tuning circuits 26 and 32 are shown separated from junction points 18 and 20, respectively, to facilitate discussion of circuit design, in practice it will normally be desirable, when such tuning circuits are included, to connect them directly to the respective junction points.

The antenna of FIG. 1 also includes Q equalization means, shown as quarter wavelength transmission line section 34 having an admittance $Y_c$. As will be described in greater detail, means 34 provides an inter-element coupling impedance effective, in conjunction with impedances $Z_a$ and $Z_b$, to increase the conductance component of the admittance at the rear junction point 18. While dimensions in FIG. 1 may be distorted for purposes of illustration, it should be noted that monopoles 10 and 12 are typically spaced by one-quarter of the free space wavelength and that references to wavelength refer to a wavelength in a frequency band in which an antenna is intended to operate, which may or may not be the same wavelength in successive such references. Also, references to "end-fire" operation will be understood to refer to operation of an antenna to provide an antenna radiation pattern for transmission or reception which is primarily directed as indicated by arrow 36 in the example of the FIG. 1 antenna. References to a "quarter-wave" or "quarter wavelength" transmission line section refer to a transmission line section having an effective electrical length such that it provides a ninety degree phase delay, in a signal traveling along the line, at an operating frequency. In practice, some adjustment or tolerance may necessarily be involved in the design and implementation of a practical antenna. In view of this, "nominally" is used to indicate that a basic quarter wavelength value or a quadrature relationship may actually be within a range of values, typically within plus or minus twenty degrees of the basic value, but which in some cases may depart by thirty degrees. Similarly, the use of "nominally" equal values denotes instances in which the value of one parameter may differ within a range of twenty percent, and in some cases possibly by thirty-three percent from the value of a compared parameter.

FIG. 1 Design and Operation

Description of the design and operation of the FIG. 1 antenna will be developed by first considering a two-element antenna as would be shown in FIG. 1 after removal of transmission line sections 14, 16 and 34. Line sections 14 and 16 are then replaced with simple conductors, while no connection is provided between junction points 18 and 20. Thus, the antenna configuration to first be considered includes two monopoles which are fed quadrature signals by action of the directional coupler 24. The presence or absence of tuning circuits 26 and 32 will not be important for purposes of the present discussion.

For purposes of analysis, consider an example based upon use of two previously-developed top-loaded monopoles with quarter wave separation and having the following dimensions and relevant characteristics. Each monopole includes a 0.01 inch diameter vertical member supporting a horizontal 0.04 inch diameter, 1.96 inch long, top loading element with a center line spacing of 1.2 inches from the ground plane for use at a midband operating frequency of 1,060 MHz. By computer computation, these elements have a self impedance (with reactance tuned out at mid band) $Z_s$ of 15.8 Ω and a mutual impedance $Z_m$ of 8.4–j10.7 Ω. The self impedance of 15.8 Ω is essentially the radiation resistance of this electrically-short monopole.

For an active end-fire array:

$$V_1 = I_1 Z_s + I_2 Z_m = j15.8 + 1(8.4 - j10.7) = 8.4 + j5.1 \quad (1)$$

$$Z_1 = \frac{V_1}{I_1} = \frac{8.4 + j5.1}{j} = 5.1 - j8.4\Omega \quad (2)$$

= active impedance of rear monopole $$V_2 = I_2 Z_s + I_1 Z_m = 1(15.8) + j(8.4 - j10.7) = 26.5 + j8.4 \quad (3)$$

$$Z_2 = \frac{V_2}{I_2} = \frac{26.5 + j8.4}{1} = 26.5 + j8.4\Omega \quad (4)$$

= active impedance of forward monopole

Note that for the rear monopole the resistance $R_1$ (i.e., the real portion of $Z_1$) is only 5.1 Ω, which is much less than the self resistance $R_s$ of 15.8 Ω. This indicates that the Q of the rear monopole has been undesirably increased by a substantial factor when this end-fire array antenna operates on an active basis (with line sections 14, 16 and 34 excluded, as noted). At the same time, the resistance $R_2$ of the forward monopole $R_2$ is 26.5 Ω, which is greater than the $R_s$. The Q of the forward monopole has thus been lowered. The Q of the rear and forward elements have thus become unequal in the operating array.

Reference is now made to the FIG. 1 antenna with the line sections 14, 16 and 34 in place, as shown. Assume first that the midband reactance of the elements is tuned out without changing the element resistance. Then add a nominal reactance Δx for the reactive effect for frequencies off midband and assume Δx is the same for both elements, which is a reasonable approximation for high-Q elements. Analysis of the FIG. 1 antenna system yields:

$$Y_{1in} = \frac{R_1 + j\Delta x}{Z_a^2} + \frac{Z_b}{Z_a} Y_c \tag{5}$$

$$\frac{\text{net } B_{1in}}{\text{net } G_{1in}} = \frac{\Delta x}{R_1 + Z_b Z_a Y_c} \tag{6}$$

$$Y_{2in} = \frac{R_2 + j\Delta x}{Z_b^2} - \frac{Z_a}{Z_b} Y_c \tag{7}$$

$$\frac{\text{net } B_{2in}}{\text{net } G_{2in}} = \frac{\Delta x}{R_2 - Z_a Z_b Y_c} \tag{8}$$

The Q at each junction point is proportional to net $B_{in}$/net $G_{in}$. If the transmission line 34 was not present, $Y_c$ would be zero and the Q at junction point 18 would be greater than the Q at junction point 20 because $R_1$ is less than $R_2$. However with transmission line 34 present, the availability of parameter $Y_c$ permits the net $G_{1in}$ to be increased and the net $G_{2in}$ to be decreased without changing the net $B_{1in}$ or the net $B_{2in}$. This will allow the equalization of the Q at the two junction points. To achieve this, set:

$$R_1 + Z_b Z_a Y_c = R_2 - Z_a Z_b Y_c \tag{9}$$

therefore:

$$Z_a Z_b Y_c = \frac{R_2 - R_1}{2} \tag{10}$$

Using the values from the prior example, $R_2 \equiv 26.5$ Ω, $R_1 \equiv 5.1$ Ω, yields:

$$Z_a Z_b Y_c = \frac{26.5 - 5.1}{2} = 10.7\Omega \tag{11}$$

As a result:

$$R_1 + Z_b Z_a Y_c = R_2 - Z_a Z_b Y_c = 15.8\ \Omega \tag{12}$$

Note that this value, which is the apparent radiation resistance of both monopole elements, is equal to their self resistance $R_s$ (i.e., the radiation resistance of one element when the other element is open circuited).

With reference to equations (2) and (4) it will be seen that the resistive components of the active impedances of the elements have the form:

$$R_1 = R_s + X_m \text{ and } R_2 = R_s - X_m, \tag{13}$$

so that:

$$\frac{R_2 - R_1}{2} = -X_m \text{ and } \frac{R_2 + R_1}{2} = R_s \tag{14}$$

and from equation (10):

$$Z_a Z_b Y_c = \frac{R_2 - R_1}{2} = -X_m \tag{15}$$

and, as in equation (12):

$$R_1 + Z_b Z_a Y_c = R_2 - Z_b Z_a Y_c = R_s \tag{16}$$

and also:

$$R_{1in} = \frac{Z_a^2}{R_s} \text{ and } R_{2in} = \frac{Z_b^2}{R_s} \tag{17}$$

Thus, it is seen that the inter-element coupling impedance of the Q equalization line 34 is effective to cancel the effect of the element mutual reactance $X_m$, thereby leaving both input resistances equal to the element self resistance $R_s$ transformed through the quarter wave lines 14 and 16, respectively.

Attention will now be directed to the proportioning of line impedances in application of the invention to practical antennas. Assume now that it is desired, in a particular antenna, to provide that both $R_{1in}$ and $R_{2in}$ have values of 50 Ω.

In this case:

$$Z_a = Z_b = \sqrt{50R_s} = \sqrt{50 \times 15.8} = 28.1\Omega \tag{18}$$

$$Z_c = \frac{1}{Y_c} = \frac{2Z_a Z_b}{R_2 - R_1} = \frac{Z_a Z_b}{-X_m} = \frac{28.1^2}{10.7} = 73.8\Omega \tag{19}$$

In general:

$$Z_c = \frac{R_s}{-X_m} \sqrt{R_{1in} R_{2in}} = \frac{(R_2 + R_1)\sqrt{R_{1in} R_{2in}}}{R_2 - R_1} \tag{20}$$

It can be noted that $Z_c$ will be positive when $X_m$ is negative (as in the present example). If $X_m$ were positive, then the inter-element coupling impedance would be provided by a transmission line section three-quarters wavelength long, in place of the one-quarter wavelength line 34, and the sign of equation (20) should be reversed.

Thus, the desired $R_{1in}$ and $R_{2in}$ input values of 50 Ω are provided, in this example using the particular top-loaded monopoles as described above, by providing:

line section 34 as a quarter wave line having an impedance of 73.8 Ω, and line sections 14 and 16 as quarter wave lines each having an impedance of 28.1 Ω.

These are mid-band values with the mid-band reactance of each element assumed to be tuned out, as discussed above.

Referring now to the complete antenna as represented in FIG. 1, the following should be observed. A series tuning reactance for adjusting the impedance presented by each of elements 10 and 12 can be inserted at the respective element input/output ports 38 and 40. However, a shunt device should not be connected at these ports because that would change the current at that point. Thus, a conventional shunt double-tuning circuit should not be used at the element port. An appropriate double tuning circuit can be located at or below the respective rear and forward junction points 18 and 20. In the illustrated example, series resonant circuits 26 and 32 are coupled to these junction points. As noted above, while certain dimensions in FIG. 1 have been distorted to aid in descriptive circuit analysis, in practice the circuits 26 and 32 may connect directly to the junction points 18 and 20. Alternative forms of double tuning circuits in antennas using the invention may include various combinations of line lengths, stubs, etc., as available in the prior art.

If the transmission line sections 14, 16 and 34 are designed as described, the power of the first and second signal portions delivered to junction points 18 and 20 (as provided by the two outputs of directional coupler 24) should be essentially equal. Thus, the desired signals can be provided by use of a 3 dB type directional coupler 24, which is a known type of device including a resistive termination 42. In practice, tolerances on the measurement and specification of impedances, and other effects, may require an adjustment of the directional coupler design to provide a coupling value somewhat different from 3 dB in order to obtain optimum end-fire radiation performance. The term "3 dB type" is used to indicate that adjustment may result in a coupler having coupling values differing somewhat from 3 dB. Also, if the reactive portions of the active element impedances $Z_1$ and $Z_2$ are tuned out (i.e., $X_1=X_2=0$) at mid-band, then the desired quadrature phase relationship of currents in the elements 10 and 12 can be provided by coupler 24. In practice, some adjustment of phase may be necessary during design to yield best results.

Dual Slot Antennas

Figure 2:
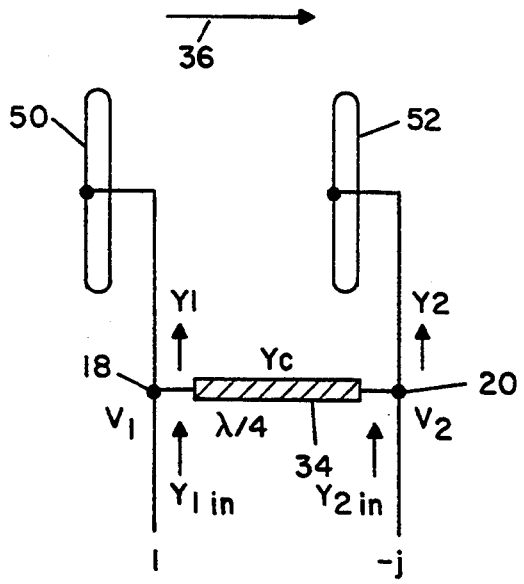
FIGS. 2, 3, 4, 5 and 6 show embodiments of dual-slot end-fire array antennas using the invention.

Referring now to FIG. 2, there is shown a conceptual form of dual slot antenna in accordance with the invention. The slots, which may be elongated openings in the metal surface of an aircraft and may be backed-up by suitable cavity arrangements, may typically be one-half wavelength in length and spaced by one-quarter wavelength from each other. As with the FIG. 1 antenna, by appropriately providing quadrature relationship signals to rear slot element 50 and forward slot element 52 of FIG. 2, an end-fire radiation pattern directed to the right in FIG. 2 can be provided. As will be further described, although the FIG. 2 slot configuration is simpler in not including the quarter wave lines 14 and 16 of FIG. 1, it is somewhat more complex in the implementation of connecting means capable of providing necessary electrical lengths or phase relationships for coupled signals.

With reference to FIG. 2 and consistent with the preceding discussion, for the dual slot configuration:

$$Y_{1in}=Y_1+Y_c \quad Y_{2in}=Y_2-Y_c \tag{21}$$

Following the lines of the preceding discussion, first assume that the midband susceptance B of each slot is tuned out without changing the slot conductance G. Then add ΔB for the susceptance effect of changing the frequency off the mid-band frequency. Assume ΔB is the same for both slots 50 and 52, which is a good assumption for slots having shallow cavities yielding high Q. Then:

$$Y_{1in} = G_1 + j\Delta B + Y_c \tag{22}$$

$$\frac{\text{net } B_{1in}}{\text{net } G_{1in}} = \frac{\Delta B}{G_1 + Y_c} \tag{23}$$

$$Y_{2in} = G_2 + j\Delta B - Y_c \tag{24}$$

$$\frac{\text{net } B_{2in}}{\text{net } G_{2in}} = \frac{\Delta B}{G_2 - Y_c} \tag{25}$$

To provide equal Q at both inputs:

$$G_1+Y_c=G_2-Y_c \tag{26}$$

and, therefore:

$$Y_c = \frac{G_2 - G_1}{2} \tag{27}$$

The active slot conductances are related to the self-conductance $G_s$ and the mutual susceptance $B_m$ as follows:

$$G_1=G_s+B_m \text{ and } G_2=G_s-B_m \tag{28}$$

Therefore:

$$\frac{G_2 - G_1}{2} = -B_m \text{ and } \frac{G_1 + G_2}{2} = G_s \tag{29}$$

and:

$$Y_c=-B_m \tag{30}$$

also:

$$G_s=G_1+Y_c=G_2-Y_c \tag{31}$$

and:

$$G_{1in}=G_{2in}=G_s \tag{32}$$

The dual slot antenna as illustrated in FIG. 2 may present implementation difficulties relating to keeping the slot excitation connections short while also using the probable short physical length of the one-quarter wavelength transmission line 34 loaded with dielectric, which is to be connected between the inputs to the slots 50 and 52 which are spaced by a quarter wavelength in free space. Such implementation considerations can be addressed as follows.

Figure 3:
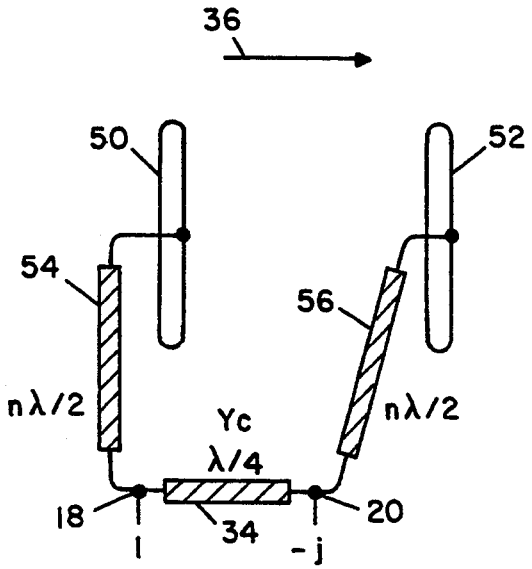
Figure 4:
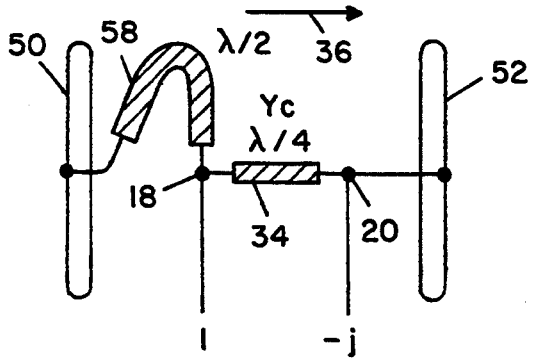
Figure 5:
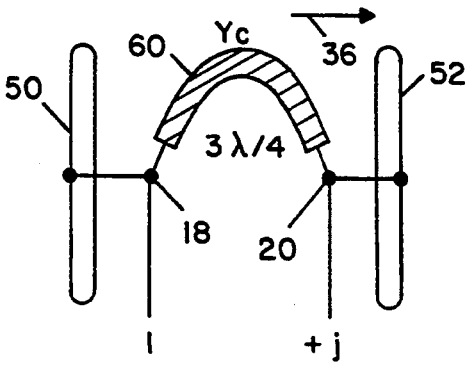

FIG. 3 shows the use of rear and forward transmission line sections 54 and 56, whose length is a multiple of one-half wavelength, to provide greater flexibility in positioning and intercoupling of the antenna components. In both FIG. 2 and FIG. 3 the slots are similarly excited, i.e., both excitation leads connect to the same side of the slots (either the right side or the left side). FIGS. 4 and 5 show arrangements wherein the slot excitation lines connect to opposite sides of the respective slots to provide a phase reversal relationship. In FIG. 4, a single half-wavelength line 58 is used to connect rear junction point 18 to rear slot 50, while forward slot 52 is directly connected to forward junction point 20. In FIG. 5 a three-quarter wavelength transmission line 60 is connected between the junction points 18 and 20, and the forward junction point 20 is excited with a signal having leading quadrature phase. In each of these embodiments the arrangement is effective to provide a quadrature phase relationship between signal portions supplied to the two slot elements to provide an end-fire radiation pattern directed to the right in each drawing, provided the line length represented by the slot exciters is minimized, or taken into account, or both.

Figure 6:
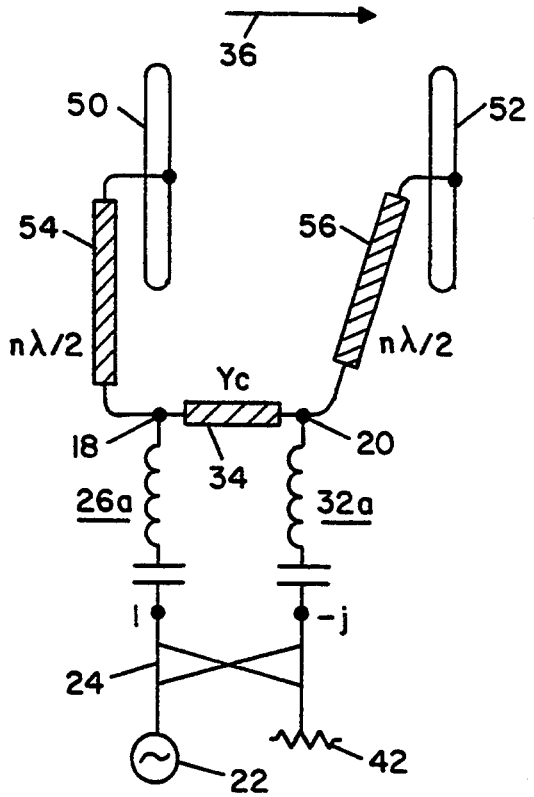

FIG. 6 illustrates a FIG. 3 type dual slot antenna to which a feed arrangement similar to the FIG. 1 feed means has been added. As shown in FIG. 6, the series resonant double tuning circuits 26a and 32a can appropriately be located in the respective feed paths just below the rear and forward junction points 18 and 20. If the transmission line sections 54, 56 and 34 are designed as described, the power of the rear and forward input signal portions delivered from the two outputs of the directional coupler 24, to junction points 18 and 20, should be essentially equal, as would be provided by a 3 dB type coupler. If the active element susceptances are tuned out ($B_1=B_2=0$) at midband, then the quadrature phase signal relationship provided by directional coupler 24 should quite accurately yield the desired quadrature voltages at the slots 50 and 52. It will be understood, that in accordance with established antenna design practices, coupling and phase values may require some adjustment during design in order to provide optimum end-fire radiation performance.

Figure 7:
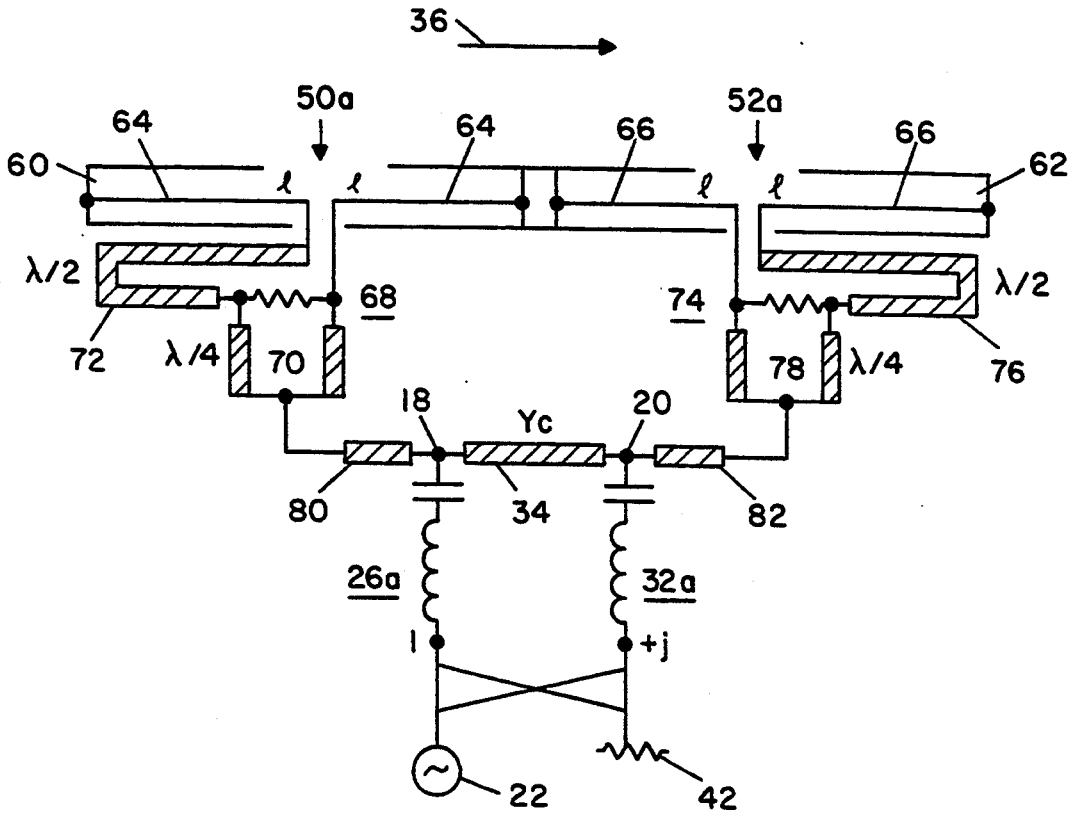
FIG. 7 shows an arrangement including cavity-backed slots with balanced exciters and Q equalization.

With reference now to FIG. 7, there is illustrated a specific embodiment of a dual-element end-fire array implemented in the form of rear and forward slots 50a and 52a (shown in an end-view cross section) backed up by cavities 60 and 62. In this embodiment, excitation of slot 50a is provided via a balanced exciter arrangement including dual conductors 64 connected at one end to the cavity wall and at the other end to a signal coupling means in the form of a balun 68 consisting of a Wilkinson type parallel line signal divider 70 and a half wavelength transmission line section 72. Forward slot 52a has a similar combination of exciter 66 coupled to signal coupling means in the form of balun 74, including half-wave line 76 and Wilkinson type divider 78. As shown, dividers 70 and 78 each include two parallel quarter wavelength sections coupled at one end by a resistor and interconnected at their other ends. In the FIG. 7 circuit the half-wave (or multiple thereof) lines 54 and 56 are replaced by transmission line segments 80 and 82. The electrical lengths of each of lines 80 and 82 is selected so that its length, in combination with the effective lengths of the respective exciter 64 or 66 and divider 70 or 78, equals a multiple of one-half wavelength. The line sections 72 and 76 merely add additional half-wavelength segments. However, any impedance transformation caused by the length of the exciters 64 and 66 and the quarter wavelength lines of dividers 70 and 78 and line segments 80 and 82 must be taken into account in determination of the value of $Y_c$ of inter-element coupling line 34.

Antenna Design Methods

Following is one approach to the basic design and adjustment of a FIG. 1 type of antenna for use of the invention.

The monopoles are first set up above a large metal groundplane with the desired quarter wavelength spacing and with any intended radome in place over the radiators. Adjustments are then made as follows. (A) Adjust the relative phase and amplitude of quadrature phase signals supplied to the two elements to achieve a high front-to-back ratio of end-fire array radiation at mid-band. (B) Tune both monopoles (independently) for zero reactance at the monopole terminals at mid-band. (C) Repeat steps (A) and (B) until both a high front-to-back ratio and zero midband reactance for both monopoles are achieved simultaneously. Then, measure the active resistance components ($R_1$ and $R_2$) at the monopole terminals and compute the value of $R_s=(R_2+R_1)/2$. Specify the desired values of $R_{1in}$ and $R_{2in}$, which are typically 50 Ω. Compute the values of:

$$Z_a = \sqrt{R_s R_{1in}} \text{ and } Z_b = \sqrt{R_s R_{2in}} \tag{33}$$

which are the impedances of quarter wavelength line sections 14 and 16, respectively, in FIG. 1. Then compute the value of:

$$Z_c = \frac{2Z_a Z_b}{R_2 - R_1} \tag{34}$$

which is the desired inter-element coupling impedance of the Q equalization quarter wavelength transmission line section 34 in FIG. 1. Build the line sections 14, 16 and 34 as computed above, and connect them to the monopoles. Adjust the relative phase and amplitude of quadrature phase signals supplied to the two junction points to achieve a high front-to-back ratio of end-fire radiation. Measure the active impedance at the two junction points. Adjust the impedances of line sections 14, 16 and 34 to obtain optimum input impedance. Add double-tuning circuits 26 and 32 and directional coupler 34. Adjust 26, 32 and 34 to optimize input impedance and front-to-back ratio.

This basic design approach may be applied for monopole, dipole or slot antennas by persons skilled in antenna system design, with variations and augmentation as may be appropriate in different applications and varied forms of antennas using the invention. More particularly, the desired inter-element coupling impedance is more easily determined for a slot antenna embodiment. First the slot elements are tuned, while excited with quadrature phase signals of adjustable relative amplitudes, as described at (A) and (B) above to achieve low element susceptance and a high front-to-back radiation level ratio. Then after determining the active conductance of each slot element as tuned, the inter-element coupling impedance corresponds inversely to one-half of the difference between the conductances of the two slot elements.

Other Applications

As discussed above, the inventor's prior application Ser. No. 07/458,220 describes linear array antennas having three or more small radiating elements and in which forced excitation is employed to achieve efficient end-fire operation. The disclosure of such application is hereby incorporated by reference into the present description.

Figure 8:
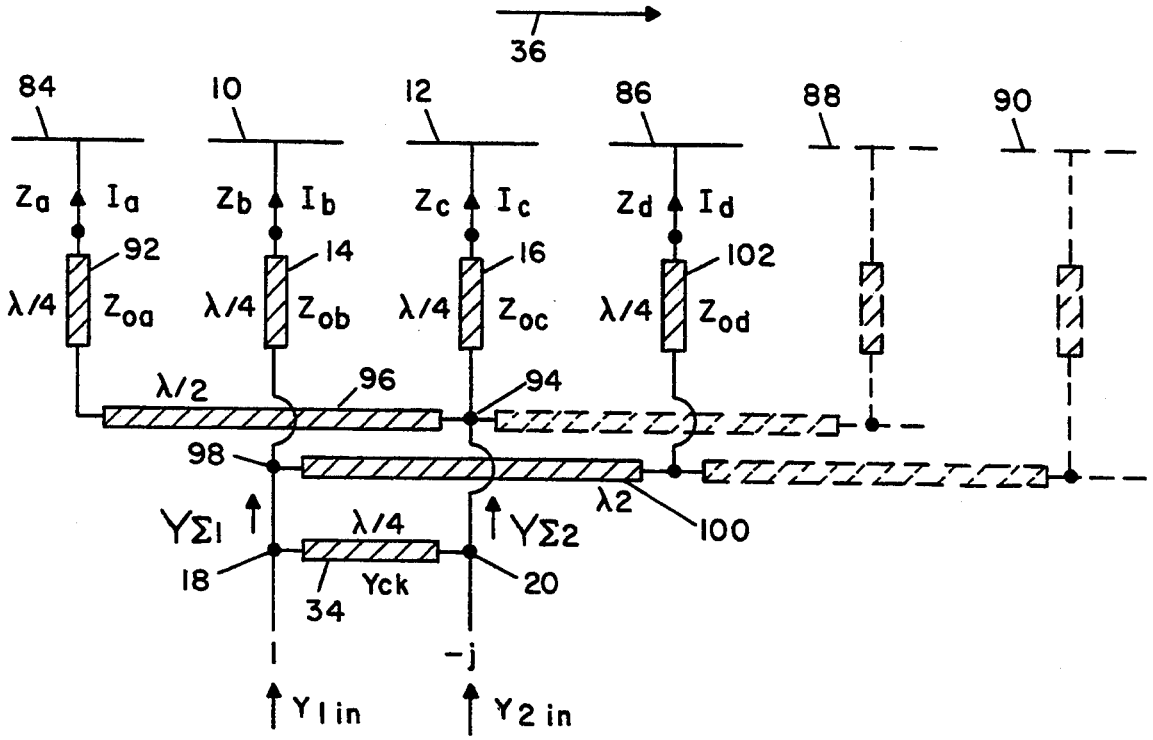
FIG. 8 shows a multi-element array using the FIG. 1 type element pair supplemented by additional forced-fed elements.

With reference now to FIG. 8, there is illustrated an embodiment of the present invention which additionally incorporates forced feeding in a multiple element linear array utilizing the present invention. FIG. 8 shows a linear array of four top-loaded monopoles, including monopoles 10 and 12 preceded by monopole 84 and followed by monopole 86, plus two additional similar monopoles 88 and 90, shown dotted as optional additions.

Initially considering only monopole elements 10 and 12 in FIG. 8, it will be seen that the combination of elements 10 and 12, quarter wave sections 14 and 16, rear and forward junction points 18 and 20, and inter-element coupling line 34 are arranged as in FIG. 1. The elements 10 and 12, when appropriately excited in quadrature, thus provide a dual-element end-fire array as previously described. Considering now only the monopole elements 12 and 84, it will be seen that (with quarter wave spacing of elements 10 and 12 and the same spacing of remaining elements) the elements 12 and 84 are spaced by one-half wavelength and, for end-fire operation, are appropriately excited with signals of opposite phase. As fully explained in said application Ser. No. 07/458,220, the provision of line sections 16 and 92 (which provide the function of quarter wave transformers) and half-wave line section 96 enable elements 12 and 84 to be force fed, via point 94 (which acts as a point of common voltage). A result of such forced feeding is that mutual coupling between elements, which would otherwise severely distort the desired relationship between currents in elements 12 and 84, does not distort that relationship. The forced-feed configuration, in accordance with the inventor's prior invention and including element 10 between the two forced fed elements in accordance with the present invention, thus permits provision of an end-fire radiation pattern with small closely spaced elements.

With this brief overview, as augmented by the prior specification, the forced-feed configuration can be extended to element 86 which, as shown, is coupled to element 10 via point 98, half-wave line 100 and quarter-wave transformer 102. Additional elements, such as 88 and 90, may be added as desired by provision of half-wave lines which respectively couple the feeds to alternate monopole elements at points immediately below the quarter-wave sections, such as 16 and 102. Thus, it will be seen that the FIG. 8 type antenna can be viewed as establishing the basic feed relationship between two adjacent elements (i.e., 10 and 12) by use of the Q equalization inter-element coupling impedance of line 34, and then extending the signal feed arrangement to additional elements by forced feeding. Tuning circuits, corresponding to 26 and 32 in FIG. 1, and a directional coupler, corresponding to 24 in FIG. 1, can be added to the FIG. 8 antenna as one appropriate way in which to provide the desired quadrature phase signals for end-fire operation.

In the design of a FIG. 8 type antenna effective end-fire performance can be achieved on the basis of equalizing the Qs at the two input ports. Consistent with design analysis relating to the FIG. 1 antenna, if $Q_1$ is to equal $Q_2$, necessary relationships are as follows, assuming $Z_{ob}/Z_{od} \equiv Z_{oc}/Z_{oa} \equiv k$, then:

$$R_b + k^2R_d + Z_{ob}Z_{oc}Y_{ok} = R_c + k^2R_a - Z_{oc}Z_{ob}Y_{ok} \tag{35}$$

and:

$$Y_{ok} = \frac{(R_c + k^2R_a) - (R_b + k^2R_d)}{2Z_{ob}Z_{oc}} \tag{36}$$

Also:

-continued $$Z_{ob} = \sqrt{\frac{(R_b + k^2R_d) + (R_c + k^2R_a)}{2G_{1in}}} \tag{37}$$

and:

$$Z_{oc} = \sqrt{\frac{(R_b + k^2R_d) + (R_c + k^2R_a)}{2G_{2in}}} \tag{38}$$

While there have been described the currently preferred embodiments of the invention, those skilled in the art will recognize that other and further modifications and variations may be made without departing from the invention and it is intended to claim all such modifications and variations as fall within the scope of the invention.

What is claimed is:

1. A dual-element end-fire array antenna with improved Q equalization, comprising:

a linear array of radiating elements including a rear element and a forward element;

rear coupling means, having a first impedance, for coupling signals to said rear element from a rear junction point;

forward coupling means, having a second impedance, for coupling signals to said forward element from a forward junction point;

input means for coupling an input signal;

feed means for coupling a first signal portion, having a reference phase, from said input means to said rear junction point and for coupling a second signal portion, having a nominally quadrature phase relation to said reference phase, from said input means to said forward junction point; and Q equalization means, coupled between said rear and forward junction points and having an effective length nominally equal to an odd multiple of one-quarter wavelength at a frequency in said operating frequency band, for providing an inter-element coupling impedance effective, in conjunction with said first and second impedances, to increase the conductance component of the admittance at said rear junction point.

2. An array antenna as in claim 1, wherein said radiating elements are two monopoles spaced by one-quarter wavelength at a frequency in an operating frequency band, said rear and forward coupling means are quarter wavelength transmission line sections, and said Q equalization means is a quarter wavelength transmission line section.

3. An array antenna as in claim 2, wherein said feed means comprises a 3 dB type directional coupler.

4. An array antenna as in claim 3, wherein said feed means additionally comprises two double-tuning circuits, one connected to each of said rear and forward junction points.

5. An array antenna as in claim 1, wherein said Q equalization means comprises a quarter wavelength transmission line section of impedance $Z_c$ approximately equal to $R_s$ (the self resistance of each of said rear and forward elements) divided by $X_m$ (the mutual reactance of said rear and forward elements, stated as a positive value) times the square root of $R_{1in}$ times $R_{2in}$ (the product of the input resistances at said rear and forward junction points).

6. An array antenna as in claim 1, wherein said radiating elements are two slot radiating elements and said Q equalization means is a transmission line section having an effective electrical length equal to an odd multiple of a quarter wavelength at a frequency in an operating frequency band.

7. An array antenna as in claim 6, wherein said feed means comprises a 3 dB type directional coupler.

8. An array antenna as in claim 7, wherein said feed means additionally comprises two double-tuning circuits, one connected to each of said rear and forward junction points.

9. An array antenna as in claim 1, additionally comprising:

a back element, positioned to the rear of said rear element, and a front element, positioned forward of said forward element, said back, rear, forward and front elements being similar radiating elements arranged in a linear array with inter-element spacing of one-quarter wavelength at said frequency in said operating frequency band;

back coupling means for coupling signals to said back element;

front coupling means for coupling signals to said front element;

a back feed line for coupling signals from said forward junction point to said back coupling means to feed said back element; and a front feed line for coupling signals from said rear junction point to said front coupling means to feed said front element.

10. An array antenna as in claim 9, wherein said radiating elements are monopoles, each of said coupling means is a quarter wavelength transmission line section, and each of said back and front feed lines is a half wavelength transmission line section, said wavelengths relating to a frequency in said operating frequency band.

11. An array antenna as in claim 9, wherein said feed means comprises a 3 dB type directional coupler.

12. An array antenna as in claim 11, wherein said feed means additionally comprises two double-tuning circuits, one connected to each of said rear and forward junction points.

13. A dual-element end-fire array antenna, comprising:

a radiating element pair including a rear element and a forward element spaced by one quarter wavelength at a frequency in an operating frequency band;

a rear coupling line one quarter wavelength long at a frequency in said operating frequency band and coupled between said rear element and a rear junction point, said rear coupling line having a first impedance;

a forward coupling line one quarter wavelength long at a frequency in said operating frequency band and coupled between said forward element and a forward junction point, said forward coupling line having a second impedance;

feed means for coupling a first input signal portion to said rear junction point and for coupling a second input signal portion, having a nominally quadrature phase relationship to said first input signal portion, to said forward junction point; and intercoupling line means, one quarter wavelength long at a frequency in said operating frequency band and coupled between said rear and forward junction points, for providing an inter-element coupling impedance effective to at least partially offset effects of mutual coupling between said rear element and said forward element.

14. An array antenna as in claim 13, wherein said rear and forward elements are monopoles.

15. An array antenna as in claim 13, wherein:

the desired input impedance to each of said rear and forward elements is 50 ohms;

said first and second impedances each have a value nominally equal to the value of the square root of the product of the average of the mid-band active resistances of said rear and forward elements times 50 ohms; and said inter-element coupling impedance has a value nominally equal to twice the product of said first and second impedances, divided by the difference between said mid-band active resistances of said forward and rear elements.

16. A dual-element end-fire array antenna, comprising:

a rear slot element and a forward slot element spaced by one-quarter wavelength at a frequency in an operating frequency band;

rear coupling means for coupling signals to said rear slot element from a rear junction point;

forward coupling means for coupling signals to said forward slot element from a forward junction point;

feed means for coupling a first input signal portion to said rear junction point and for coupling a second input signal portion, having a nominally quadrature phase relationship to said first input signal portion, to said forward junction point; and intercoupling line means, an odd multiple of one-quarter wavelength long at a frequency in said operating frequency band and coupled between said rear and forward junction points, for providing an inter-element coupling impedance effective to at least partially offset effects of mutual coupling between said rear slot element and said forward slot element.

17. An array antenna as in claim 16, wherein each of said rear and forward coupling means is a transmission line section which is a multiple of one-half wavelength long at a frequency in said operating frequency band.

18. An array antenna as in claim 16, wherein said rear coupling means is a transmission line section one-half wavelength long at a frequency in said operating frequency band.

19. An array antenna as in claim 16, wherein said intercoupling line means is three-quarters of said wavelength long for providing said inter-element coupling impedance as described.

20. An array antenna as in claim 16, wherein said feed means comprises a 3 dB type directional coupler coupled to each of said rear and forward junction points via one of two similar double-tuning circuits.

21. An array antenna as in claim 16, wherein said slot elements are rear and forward cavity-backed slot radiating elements.

22. An array antenna as in claim 21, wherein said rear and forward coupling means each comprises: a balanced exciter connecting to walls of the cavity backing the respective slot radiating element, a balun feeding said balanced exciter, and a transmission line section having a length selected to cause the total effective series length of said balanced exciter, said balun and said transmission line section to be equal to one-half wavelength at a frequency in said operating frequency band.

23. A method for improving Q equalization in a dual-element end-fire array antenna, comprising the steps of:

(a) providing a pair of radiating elements, including a rear element and a forward element;

(b) tuning said elements, while exciting said elements with quadrature phase signals of adjustable relative amplitudes at a selected frequency, to achieve low element reactance and a high front-to-back radiation level ratio;

(c) determining the active resistance of each of said rear and forward elements when tuned and excited as in step (b);

(d) determining the average value of said active resistances as determined in step (c);

(e) specifying the desired rear input port resistance and forward input port resistance;

(f) inserting in series with said rear element a coupling device having an impedance nominally equal to the square root of the product of said average value from step (d) times said rear input port resistance from step (e);

(g) inserting in series with said forward element a coupling device having an impedance nominally equal to the square root of the product of said average value from step (d) times said forward input port resistance from step (e); and (h) inserting between said coupling devices, at junction points away from said radiating elements, a transmission line section of length nominally equal to an odd multiple of a quarter wavelength at a desired frequency and having an impedance corresponding to twice the product of the impedances described in steps (f) and (g), divided by the difference between the respective active resistances of said radiating elements as determined in step (c).

24. A method as in claim 23, wherein said elements are tuned and said relative amplitudes are adjusted in step (b) to minimize element reactance and simultaneously maximize said front-to-back radiation level ratio.

25. A method as in claim 23, wherein said rear and forward elements are monopoles and said coupling devices referred to in steps (f) and (g) are quarter wavelength transmission line sections having impedances as respectively determined in said steps (f) and (g).

26. A method for improving Q equalization in a dual-element end-fire array antenna, comprising the steps of:

(a) providing a pair of slot elements, including a rear slot element and a forward slot element;

(b) tuning said slot elements, while exciting said slot elements with quadrature phase signals of adjustable relative amplitudes at a selected frequency, to achieve low element susceptance and a high front-to-back radiation level ratio;

(c) determining the active conductance of each of said rear and forward slot elements when tuned and excited as in step (b); and (d) inserting between said slot elements, a transmission line section of length nominally equal to an odd multiple of a quarter wavelength at a desired frequency and having an impedance corresponding to the inverse of one-half of the difference between said conductances of said rear and forward slot elements as determined in step (c).

27. A method as in claim 23, wherein said slot elements are tuned and said relative amplitudes are adjusted in step (b) to minimize element susceptance and simultaneously maximize said front-to-back radiation level ratio.

* * * * *